US006805096B2

(12) United States Patent
Iizuka

(10) Patent No.: US 6,805,096 B2
(45) Date of Patent: Oct. 19, 2004

(54) CYLINDER JUDGMENT APPARATUS AND CYLINDER JUDGMENT METHOD OF ENGINE

(75) Inventor: Isamu Iizuka, Atsugi (JP)

(73) Assignee: Unisia Jecs Corporation, Atsugi (JP)

( * ) Notice: Subject to any disclaimer, the term of this patent is extended or adjusted under 35 U.S.C. 154(b) by 193 days.

(21) Appl. No.: 10/173,100

(22) Filed: Jun. 18, 2002

(65) Prior Publication Data

US 2002/0194903 A1 Dec. 26, 2002

(30) Foreign Application Priority Data

Jun. 20, 2001 (JP) ..... 2001-186639

(51) Int. Cl.[7] ..... F02D 41/22; F02P 17/00

(52) U.S. Cl. ..... 123/406.18; 73/118.1; 123/90.17; 123/479; 702/33

(58) Field of Search ..... 123/406.18, 406.62, 123/479, 90.15, 90.17; 73/116, 117.2, 117.3, 118.1; 702/33

(56) References Cited

U.S. PATENT DOCUMENTS 6,302,085 B1 * 10/2001 Sekine et al. ..... 123/406.62

6,505,128 B1 * 1/2003 Shimizu et al. ..... 702/33

FOREIGN PATENT DOCUMENTS

JP 5-106500 4/1993

* cited by examiner

*Primary Examiner*—Tony M. Argenbright
(74) *Attorney, Agent, or Firm*—Foley & Lardner LLP

(57) ABSTRACT

Cylinder judgment signals are output from cam sensors at every uneven crank angle interval. The number of cylinder judgment signals output per cam sensor during a time period between a previous output and a present output of cylinder judgment signals from the other cam sensor, is counted up, to judge a specific cylinder based on the number of outputs. As a result, cylinders other than the specific cylinder are judged based on the judgment result and the cylinder judgment signals. Simultaneously, a time period from the previous cylinder judgment to the present cylinder judgment is calculated, to judge erroneous detection of cylinder judgment signal due to noise based on a ratio between a previous calculation value and a present calculation value of the time period. When the erroneous detection is judged, the cylinder judgment result based on the cylinder judgment signals is canceled.

12 Claims, 15 Drawing Sheets

| RESULT OF CYLINDER JUDGMENT | Phase1 INPUT NUMBER | Phase2 INPUT NUMBER |
|---|---|---|
| #1cy1 | 2 | 0 |
| #2cy1 | 0 | 1 |
| #3cy1 | 1 | 2 |
| #4cy1 | 0 | 2 |
| #5cy1 | 1 | 0 |
| #6cy1 | 2 | 1 |
| ERROR | EXCEPT THE ABOVE | |

FIG.10

(A)

INITIAL REF DETECTION(WHEN #CYLBU=0)

| REF, CYLCS | DETECTION METHOD |
|---|---|
| #2 | INPUT Phase2 TO BE INPUT WHEN BCAMCNT1≧3 |
| #5 | INPUT Phase1 TO BE INPUT WHEN BCAMCNT2≧3 |

(B)

NORMAL TIME REF DETECTION(WHEN #CYLBU=1)

| REF, CYLCS | DETECTION METHOD |
|---|---|
| #1 | INPUT Phase1 TO MAKE BREFCAM1=3 |
| #2 | INPUT Phase2 TO BE INPUT WHEN BCAMCNT1≧3 |
| #3 | INPUT Phase2 TO MAKE BREFCAM2=1 |
| #4 | INPUT Phase2 TO MAKE BREFCAM2=3 |
| #5 | INPUT Phase1 TO BE INPUT WHEN BCAMCNT2≧3 |
| #6 | INPUT Phase1 TO MAKE BREFCAM1=1 |

CYLINDER JUDGMENT APPARATUS AND CYLINDER JUDGMENT METHOD OF ENGINE

FIELD OF THE INVENTION

The present invention relates to a technique for judging a cylinder corresponding to each stroke of combustion cycle based on cylinder judgment signals output from a cam sensor in a vehicle engine, and particularly relates to a technique for coping with a problem at fault time of the cam sensor.

DESCRIPTION OF THE RELATED ART

An earlier vehicle engine is equipped with a cylinder judgment apparatus for judging a cylinder corresponding to each stroke of combustion cycle for controlling fuel injection timing and ignition timing for each cylinder.

In a cylinder judgment apparatus disclosed in Japanese Unexamined Patent publication No. 5-106500, cylinder judgment signals corresponding to the number of cylinders are output from a cam sensor during a time period between outputs of reference crank angle signals from a crank angle sensor, to perform cylinder judgment.

However, in a multi-cylinder engine, for example, a six-cylinder engine, since a signal plate for outputting cylinder judgment signals needs to be provided with a maximum of six units to be detected during the time between the outputs of the reference crank angle signals, there is a problem in that the signal plate cannot be miniaturized, especially in a construction where a magnetic sensor is used to detect projections formed thereon.

SUMMARY OF THE INVENTION

The present invention has an object of providing a cylinder judgment apparatus and a cylinder judgment method of an engine, capable of performing cylinder judgment based on only signals from a cam sensor and also detecting erroneous judgment due to noise mixing, thereby improving reliability.

In order to achieve the above object, the present invention is constructed to include a plurality of cam sensors each of which outputs cylinder judgment signals for judging a cylinder corresponding to each stroke of combustion cycle for each uneven interval of a crank angle and to perform cylinder judgment by a control unit as follows.

The number of cylinder judgment signals output from one cam sensor during a time period between a previous output and a present output of cylinder judgment signals from the other cam sensor is counted up and a specific cylinder is judged based on the number of outputs, so that the cylinders other than the specific cylinder are judged based on the judgment result and the cylinder judgment signals.

On the other hand, each time the cylinder is judged by the above method, a period of from the previous cylinder judgment to the present cylinder judgment is calculated and erroneous detection of cylinder judgment signal due to noise is judged based on a ratio between a previous calculation value and a present calculation value of the period.

When the erroneous detection is judged, a cylinder judgment result based on the cylinder judgment signals is cancelled.

The other objects and features of the present invention will become understood from the following description with the accompanying drawings.

BRIEF EXPLANATION OF THE DRAWINGS

FIG. 10 shows a cylinder judgment pattern at the time of the above backup control;

DETAILED DESCRIPTION OF THE PREFERRED EMBODIMENT

Figure 1:
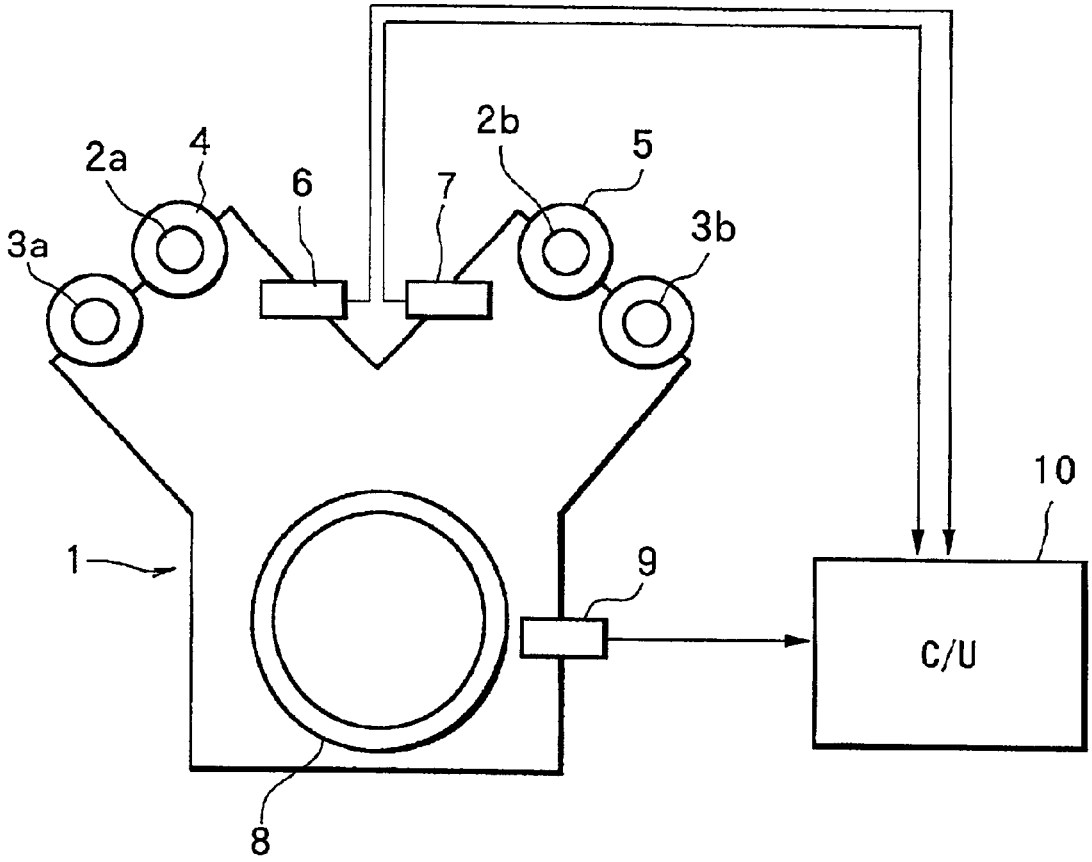
FIG. 1 is a diagram showing a system structure of a V-type six-cylinder engine in an embodiment of the present invention.

FIG. 1 is a diagram of a system structure of an engine in an embodiment.

A six-cylinder V-type engine shown in FIG. 1 is equipped with intake side camshafts 2*a* and 2*b*, and exhaust side camshafts 3*a* and 3*b* for each bank.

Signal plates 4, 5 are axially supported to the intake side camshafts 2*a* and 2*b*, respectively. A first magnetic cam sensor 6 is provided for detecting a projection (not shown in the figure) formed on the signal plate 4 to output a cylinder judgment signal Phase1 for judging a cylinder corresponding to each stroke of combustion cycle, and a second magnetic cam sensor 7 is provided for detecting a projection (not shown in the figure) formed on the signal plate 5 to output a cylinder judgment signal Phase2 for judging a cylinder corresponding to each stroke of combustion cycle.

First cam sensor 6 and second cam sensor 7 may be disposed to exhaust side camshafts 3*a* and 3*b*, respectively, on each bank, or may be disposed to intake side camshaft 2*a* and exhaust camshaft 3*a*, respectively, on one bank.

Further, a magnetic crank angle sensor 9 is provided for detecting a projection (not shown in the figure) formed on a signal plate 8 mounted on a crank pulley to output a position signal POS for each unit angle.

Detection signals from first cam sensor 6, second cam sensor 7 and crank angle sensor 9 are input to a control unit 10. Control unit 10 including a cylinder judgment function performs cylinder judgment based on the detection signals to control fuel injection or ignitions in the engine based on results of cylinder judgment. Further, the engine is equipped with an intake valve timing control apparatus and an exhaust valve timing control apparatus for changing valve timing with an operation angle being constant by changing rotation phases of the intake side and exhaust side camshafts relative to a crankshaft, respectively. Control unit 10 detects the rotation phase of the intake side camshaft based on the above detection signals to feedback control the rotation phase. The rotation phase of the exhaust side camshaft is detected based on detection signals from other sensors (not shown in the figure).

The intake valve timing control apparatus and the exhaust valve timing control apparatus are for changing valve timing with an operation angle being constant by changing the rotation phases of the intake side and exhaust side camshafts relative to the crankshaft, respectively.

As variable valve timing control apparatus, there is used a vane type variable valve timing control apparatus. The construction and operation of the vane type intake valve timing control apparatus will be described based on FIG. 2. For the exhaust valve timing control apparatus, the construction thereof is the same as that of the intake valve timing control apparatus, but advance or retard control direction to an initial portion at the non-operating time is opposite to that in the intake valve timing control apparatus.

Figure 2:
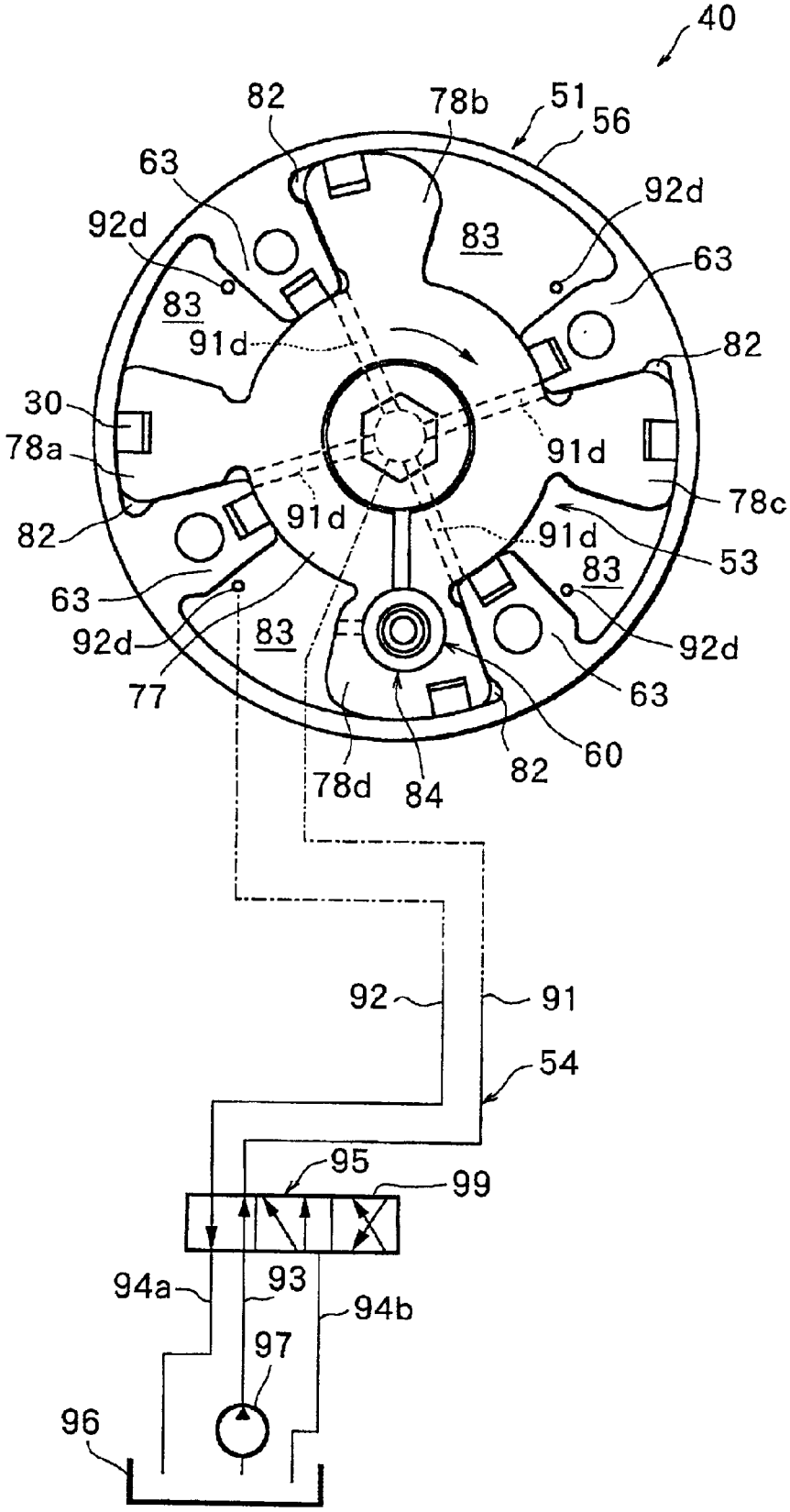
FIG. 2 is a cross section showing a vane-type valve timing control apparatus according to the embodiment.

In FIG. 2, an intake valve timing control apparatus 40 comprises: a cam sprocket 51 (timing sprocket) which is rotatably driven by the crankshaft via a timing chain; a rotation member 53 secured to an end portion of camshaft 41 and rotatably housed inside cam sprocket 51; a hydraulic circuit 54 for relatively rotating rotation member 53 with respect to cam sprocket 1; and a lock mechanism 60 for locking a relative rotation position between cam sprocket 51 and rotation member 53 at a predetermined position.

Cam sprocket 51 comprises: a rotation portion having on an outer periphery thereof, teeth for engaging with timing chain (or timing belt); a housing 56 located forward of the rotation portion, for rotatably housing rotation member 53; and a front cover and a rear cover for closing the front and rear openings of housing 56.

Furthermore, housing 56 presents a cylindrical shape formed with both front and rear ends open and with four partition portions 63 protrudingly provided at positions on the inner peripheral face at 90° in the circumferential direction, four partition portions 63 presenting a trapezoidal shape in transverse section and being respectively provided along the axial direction of housing 56.

Rotation member 53 is secured to the front end portion of camshaft 41 and comprises an annular base portion 77 having four vanes 78*a*, 78*b*, 78*c*, and 78*d* provided on an outer peripheral face of base portion 77 at 90° in the circumferential direction.

First through fourth vanes 78*a* to 78*d* present respective cross-sections of approximate trapezoidal shapes. The vanes are disposed in recess portions between each partition portion 63 so as to form spaces in the recess portions to the front and rear in the rotation direction. Advance angle side hydraulic chambers 82 and retarded angle side hydraulic chambers 83 are thus formed between the opposite sides of vanes 78*a* to 78*d* and the opposite side faces of respective partition portions 63.

Lock mechanism 60 has a construction such that a lock pin 84 is inserted into an engagement hole (not shown in the figure) at a rotation position (reference operating state) on the maximum retarded angle side of rotation member 53.

Hydraulic circuit 54 has a dual system oil pressure passage, namely a first oil pressure passage 91 for supplying and discharging oil pressure with respect to advance angle side hydraulic chambers 82, and a second oil pressure passage 92 for supplying and discharging oil pressure with respect to retarded angle side hydraulic chambers 83. To these two oil pressure passages 91 and 92 are connected a supply passage 93 and drain passages 94*a* and 94*b*, respectively, via an electromagnetic switching valve 95 for switching the passages. An engine driven oil pump 97 for pumping oil inside an oil pan 96 is provided in supply passage 93, and the downstream ends of drain passages 94*a* and 94*b* are communicated with oil pan 96.

First oil pressure passage 91 is formed substantially radially in base portion 77 of rotation member 53, and connected to four branching paths 91*d* communicating with each hydraulic chamber 82 on the advance angle side. Second oil pressure passage 92 is connected to four oil galleries 92*d* opening to each hydraulic chamber 83 on the retarded angle side.

With electromagnetic switching valve 95, an internal spool valve is arranged so as to control relative switching between respective oil pressure passages 91 and 92, and supply passage 93 and first and second drain passages 94*a* and 94*b*.

Control unit 20 controls the power supply amount to an electromagnetic actuator 99 for driving electromagnetic switching valve 95 based on a duty control signal superimposed with a dither signal.

For example, when a control signal of duty ratio 0% is output from control unit 20 to electromagnetic actuator 99, the hydraulic fluid pumped from oil pump 97 is supplied to retarded angle side hydraulic chambers 83 via second oil pressure passage 92, and the hydraulic fluid inside advance angle side hydraulic chambers 82 is discharged to inside oil pan 96 from first drain passage 94*a* via first oil pressure passage 91.

Consequently, the pressure inside retarded angle side hydraulic chambers 83 becomes a high pressure while the pressure inside advance angle side hydraulic chambers 82 becomes a low pressure, and rotation member 53 is rotated to the full to the retarded angle side by means of vanes 78*a* to 78*d*. The result of this is that the opening timing for the intake valves is delayed, and the overlap with the exhaust valves is thus reduced.

On the other hand, when a control signal of a duty ratio 100% is output from control unit 20 to electromagnetic actuator 99, the hydraulic fluid is supplied to inside advance angle side hydraulic chambers 82 via first oil pressure passage 91, and the hydraulic fluid inside retarded angle side hydraulic chambers 83 is discharged to oil pan 96 via second oil pressure passage 92 and second drain passage 94*b*, so that retarded angle side hydraulic chambers 83 become a low pressure.

Therefore, rotation member 53 is rotated to the full to the advance angle side by means of vanes 78*a* to 78*d*. Due to this, the opening timing for the intake valve is advanced (advance angle) and the overlap with the exhaust valve is thus increased.

Moreover, control unit 20 sets by proportional, integral and derivative control action, a feedback correction amount PIDDTY for making a detection value of rotation phase between cam sprocket 51 and the camshaft coincide with a target value (target advance angle amount) set corresponding to the operating conditions. Control unit 20 then makes the result of adding a predetermined base duty ratio BASEDTY (neutral control value) to the feedback correction amount PIDDTY a final duty ratio VTCDTY, and outputs the control signal for the duty ratio VTCDTY to electromagnetic actuator 99.

In the case where it is necessary to change the rotation phase in the retarded angle direction, the duty ratio is reduced by means of the feedback correction amount PIDDTY, so that the hydraulic fluid pumped from oil pump 97 is supplied to retarded angle side hydraulic chambers 83, and at the same time the hydraulic fluid inside advance angle side hydraulic chambers 82 is discharged to inside oil pan 96. Conversely, in the case where it is necessary to change the rotation phase in the advance angle direction, the duty ratio is increased by means of the feedback correction amount PIDDTY, so that the hydraulic fluid is supplied to inside advance angle side hydraulic chambers 82, and at the same time the hydraulic fluid inside retarded angle side hydraulic chambers 83 is discharged to oil pan 96. Furthermore, in the case where the rotation phase is maintained in the present condition, the absolute value of the feedback correction amount PIDDTY decreases to thereby control so as to return to a duty ratio close to the base duty ratio.

Intake valve timing control apparatus 40 (or exhaust valve timing control apparatus) is not limited to the above vane type apparatus, but there may be adopted a different type of an apparatus to change valve timing. Also, there may be adopted an apparatus for changing valve lift and/or an operating angle with or without change of valve timing.

Figure 3:
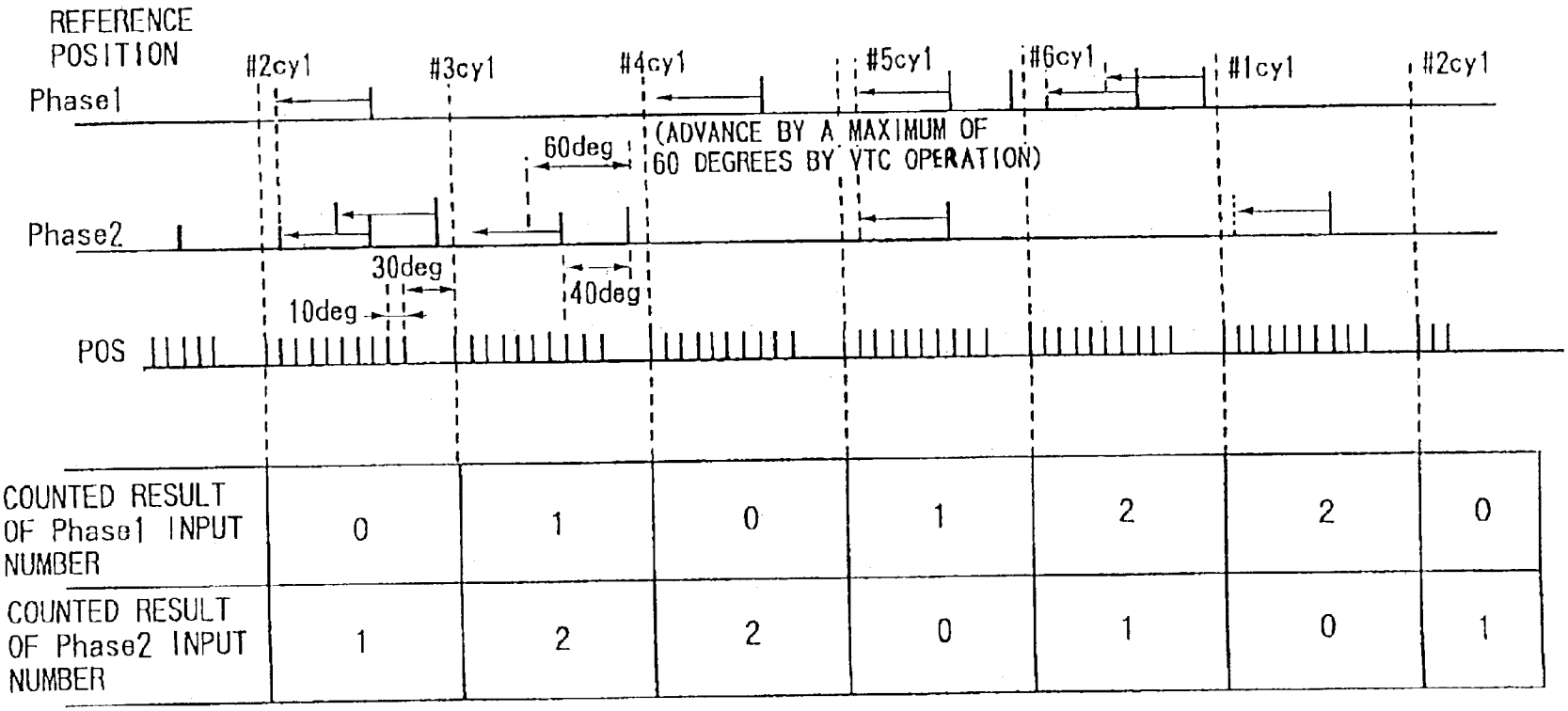
FIG. 3 is a time chart showing an output characteristic of a detection signal in the V-type six-cylinder engine.

FIG. 3 shows the output characteristics of first cam sensor 6, second cam sensor 7 and crank angle sensor 9, in the V-type six-cylinder engine. The position signal POS is not generated at each 120° CA corresponding to the stroke phase difference between cylinders. The reference crank angle position is detected by detecting the position of no signal.

On the other hand, the cylinder judgment signal Phase1 is output for zero between the reference crank angle position of #1 and the reference crank angle position of #2, for one between the reference crank angle position of #2 and the reference crank angle position of #3, for zero between the reference crank angle position of #3 and the reference crank angle position of #4, for one between the reference crank angle position of #4 and the reference crank angle position of #5, for two between the reference crank angle position of #5 and the reference crank angle position of #6, and for two between the reference crank angle position of #6 and the reference crank angle position of #1.

Further, the cylinder judgment signal Phase2 is output for one between the reference crank angle position of #1 and the reference crank angle position of #2, for two between the reference crank angle position of #2 and the reference crank angle position of #3, for two between the reference crank angle position of #3 and the reference crank angle position of #4, for zero between the reference crank angle position of #4 and the reference crank angle position of #5, for one between the reference crank angle position of #5 and the reference crank angle position of #6, and for zero between the reference crank angle position of #6 and the reference crank angle position of #1.

Accordingly, the combination patterns of the number of outputs of cylinder judgment signals Phase1 and Phase2 are six. The cylinder judgment can be performed for each cylinder depending on which of the combination patterns is judged.

Next, a cylinder judgment control based on combination patterns of the number of outputs of cylinder judgment signals Phase1 and Phase2 between the reference crank angle positions will be described in detail according to flowcharts.

Figures 4, 5:
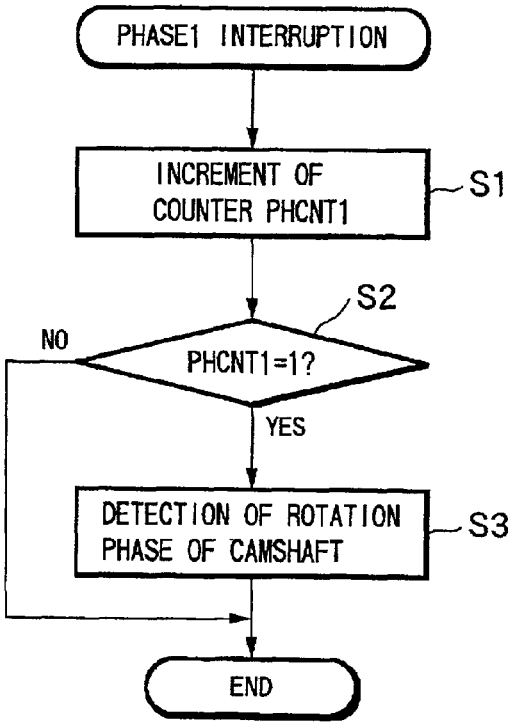
FIG. 4 shows a cylinder judgment pattern in the output characteristic of FIG. 3.
FIG. 5 is a flowchart showing a counting process of cylinder judgment signal Phase1 between reference crank angle positions.

A flowchart in FIG. 5 is a control routine to be interruptedly executed at each output of cylinder judgment signal Phase1. In step S1, a counter PHCNT1 for counting the number of outputs of cylinder judgment signal Phase1 is incremented by one.

In next step S2, it is judged whether or not counter PHCNT1 is 1 to judge whether or not the cylinder judgment signal is the leading cylinder judgment signal Phase1 after the reference crank angle position.

If counter PHCNT1 is 1, control proceeds to step S3, wherein the rotation phase (intake valve timing) of the intake side camshaft is detected based on the angle from the just before reference crank angle position to the leading cylinder judgment signal Phase1.

Figure 6:
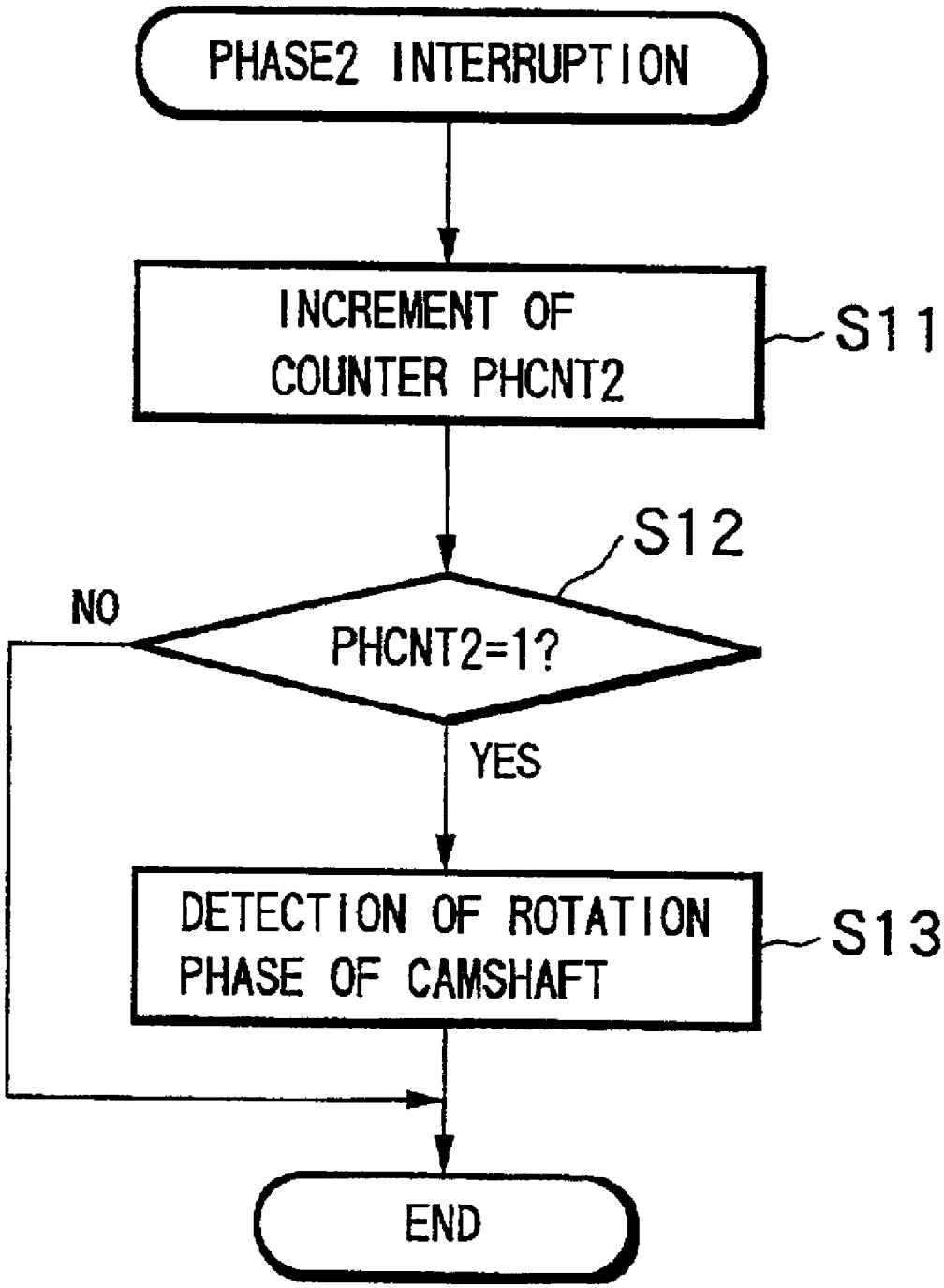
FIG. 6 is a flowchart showing a counting process of cylinder judgment signal Phase2 between reference crank angle positions.

A flowchart in FIG. 6 is a control routine to be interruptedly executed at each output of cylinder judgment signal Phase2. Similarly to the flowchart in FIG. 5, in step S11, a counter PHCNT2 for counting the number of outputs of cylinder judgment signal Phase2 is incremented by one. Then, in next step S12, it is judged whether or not counter PHCNT2 is 1. If counter PHCNT2 is 1, control proceeds to step S13, wherein the rotation phase (intake valve timing) of the intake side camshaft is detected based on the angle from the just before reference crank angle position to the leading cylinder judgment signal Phase2.

Figure 7:
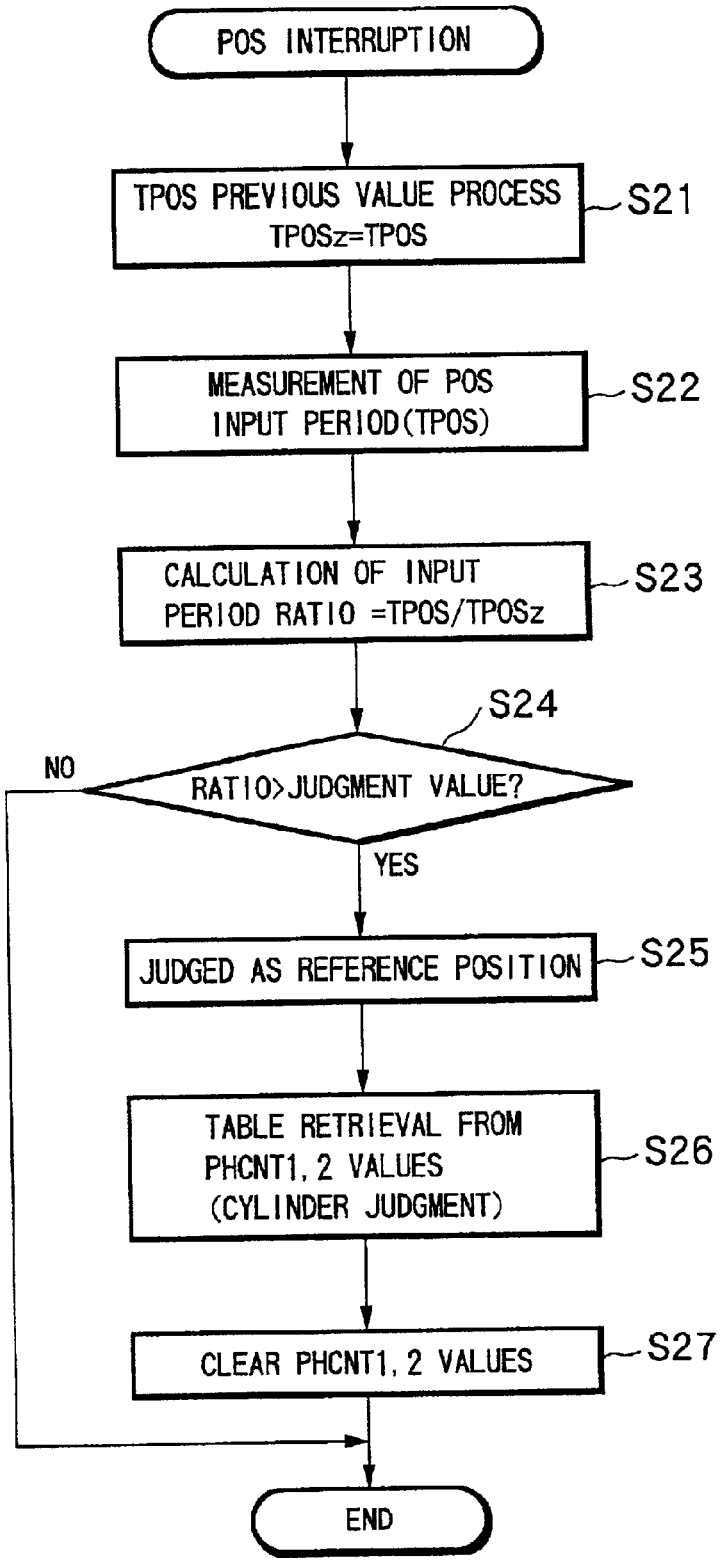
FIG. 7 is a flowchart showing a cylinder judgment process based on the count values of cylinder judgment signals Phase1 and Phase2.

A flowchart in FIG. 7 is a control routine to be interruptedly executed at each output of position signal POS. In step S21, an output period TPOS of the position signal POS is set to the previous value TPOSz, and then in next step S22, the newest period TPOS is obtained.

In step S23, a period ratio=TPOS/TPOSz is computed, and in step S24, it is judged whether or not the period ratio exceeds a judgment level to judge whether it is the position of no signal.

If the period ratio is equal to or below the judgment level, the present routine is terminated. If it is judged that the period ratio exceeds the judgment level, then control proceeds to step S25, wherein the reference crank angle position is judged.

In step S26, the cylinder judgment (cylinder judgment corresponding to the present reference crank angle position) is performed by referring to tables as shown in FIG. 4 based on counters PHCNT1 and PHCNT2 for counting the number of outputs of cylinder judgment signals Phase1 and Phase2.

In step S27, counters PHCNT1 and PHCNT2 are cleared so that the number of outputs of cylinder judgment signals Phase1 and Phase2 between the next reference crank angle positions are counted.

Next, a backup control in a case where the crank angle sensor is failed will be described.

Figure 8:
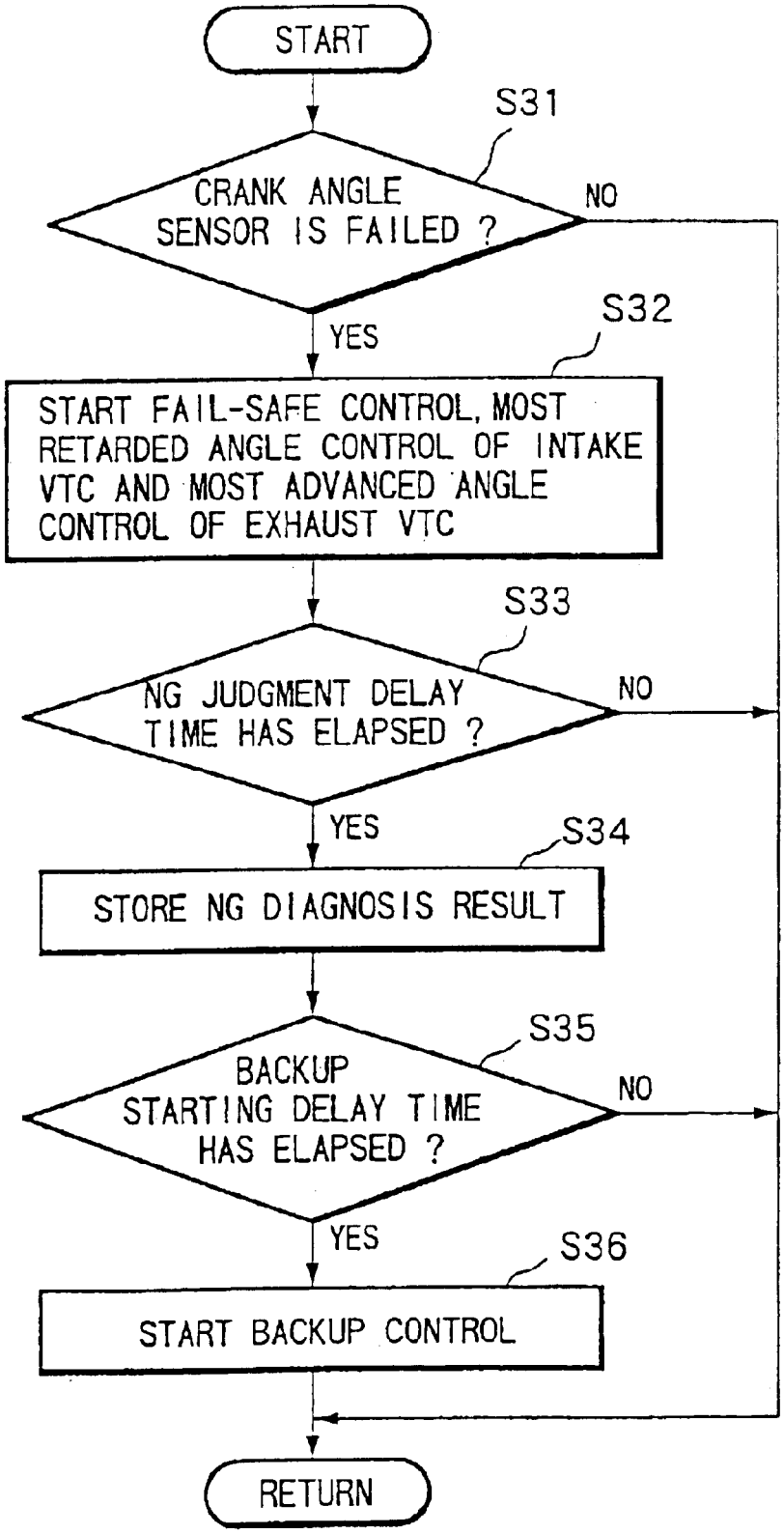
FIG. 8 is a flowchart showing a process of fault diagnosis of a crank angle sensor and a process until the starting of backup control.

FIG. 8 is a flowchart showing a routine of a process of fault diagnosis of the crank angle sensor and a process until the starting of the backup control during failure.

In step S31, it is judged whether or not crank angle sensor 9 is failed (disconnected), based on whether or not a state has continued for a predetermined time where the position signal POS is not input, although the cylinder judgment signals Phase1 and Phase2 are input.

When it is judged that the above state has continued for the predetermined time, it is diagnosed in step S32 that the crank angle sensor is failed, and a fail-safe control such as fuel cut, ignition cessation and the like, is started. At the same time, a control is started such that intake side camshafts 2*a* and 2*b* are rotated relatively to a crank angle position that is the most retarded angle position with respect to the crankshaft, and exhaust side camshafts 3*a* and 3*b* are rotated relatively to a crank angle position that is the most advanced angle position with respect to the crankshaft, by the intake/exhaust valve timing control apparatuses.

After the fault diagnosis, the lapse of a predetermined NG judgment delay time is further waited for in step S33, and in step 34, an NG diagnosis result is stored. Specifically, for example, an alarm lamp is turned on.

In step S35, the lapse of a predetermined backup start delay time is further waited for before starting the backup control according to the present invention, and in step S36, the backup control is started. That is, there is a fear of problems such as knocking during idling state if the backup control is started while the intake side camshaft is advanced or the exhaust side camshaft is retarded, so the backup control is started after the intake/exhaust valve timing control has completely ended.

The backup control will now be described in detail.

The output characteristics of the cylinder judgment signals Phase1 and Phase2 are set as follows: in the longest interval between the cylinder judgment signal Phase1 output between reference crank angle positions #2 and #3, and the cylinder judgment signal Phase1 output between reference crank angle positions #4 and #5, from first cam sensor 6, three or more cylinder judgment signals Phase2 are output from second cam sensor 7 (the number of outputs being either 3 or 4 due to a transient phase deviation between the camshafts during the rotation phase control), and in the output interval of other cylinder judgment signals Phase1, less than three cylinder judgment signals Phase2 are output; and similarly, in the longest interval between the cylinder judgment signal Phase2 output between reference crank angle positions #5 and #6, and the cylinder judgment signal Phase2 output between reference crank angle positions #1 and #2, from second cam sensor 7, three or more cylinder judgment signals Phase1 are output from first cam sensor 6, and in the output interval of other cylinder judgment signals Phase2, less than three cylinder judgment signals Phase1 are output (refer to FIG. 3).

Figure 9:
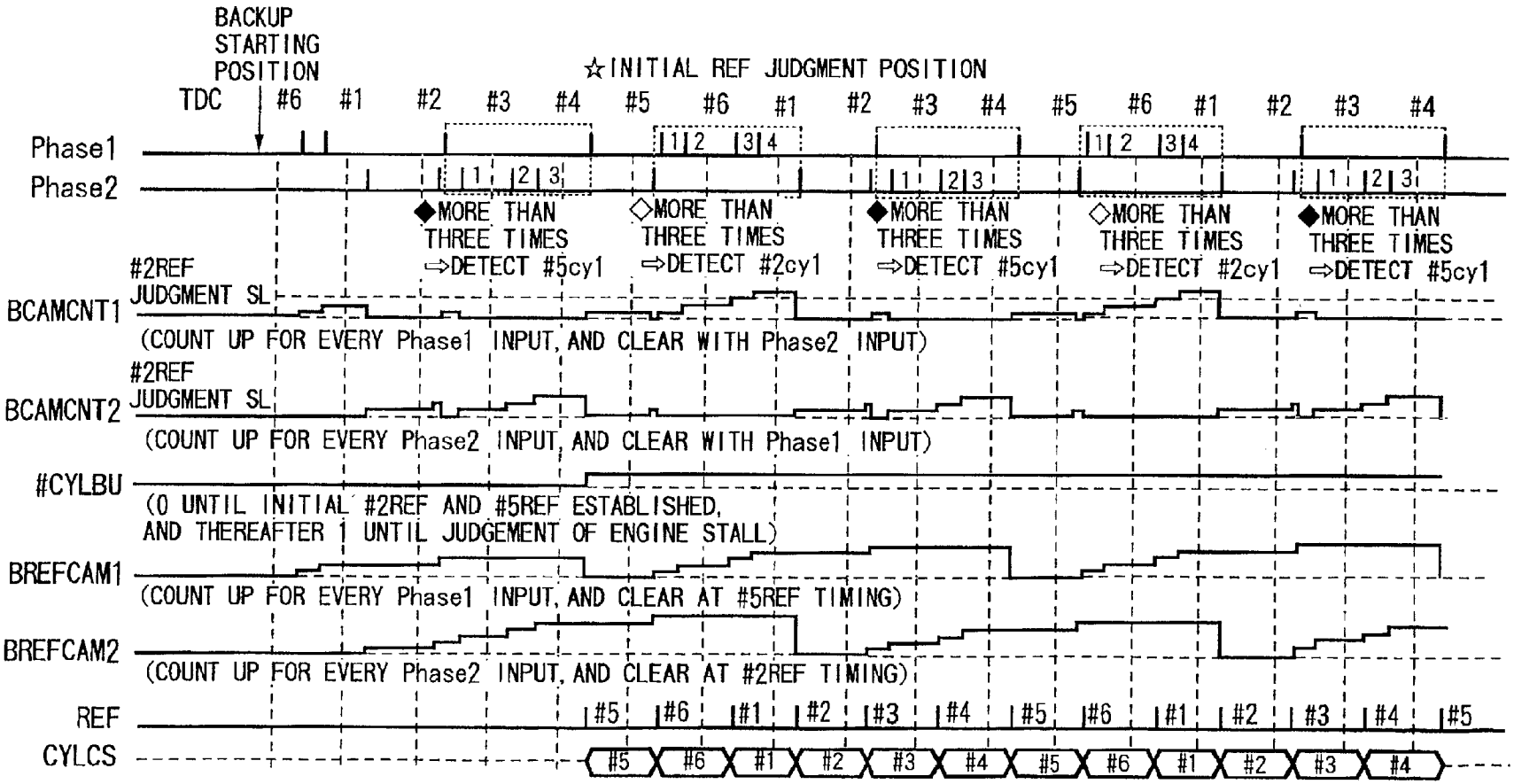
FIG. 9 is a time chart showing a state of the backup control.

Based on the above characteristics, the backup control is executed as shown in a time chart of FIG. 9.

There are provided a counter BCAMCNT1 that is counted up for every output of the cylinder judgment signal Phase1 from first cam sensor 6 and is cleared by the output of the cylinder judgment signal Phase2 from second cam sensor 7, and a counter BCAMCNT2 that is counted up for every output of the cylinder judgment signal Phase2 from second cam sensor 7 and is cleared by the output of the cylinder judgment signal Phase1 from first cam sensor 6. In other words, counter BCAMCNT1 has a function for counting the number of outputs of the cylinder judgment signals Phase1 in the interval of output of cylinder judgment signals Phase2, and counter BCAMCNT2 has a function for counting the number of outputs of the cylinder judgment signals Phase2 in the interval of output of cylinder judgment signals Phase1. When the counted value of counter BCAMCNT2 equals to or exceeds 3, the termination time of that output interval, in other words, the time when the cylinder judgment signal Phase1 to be output between reference crank angle positions #4 and #5 is output, is detected as the reference crank angle position of #5 cylinder. Similarly, when the counted value of counter BCAMCNT1 equals to or exceeds 3, the termination time of that output interval, in other words, the time when the cylinder judgment signal Phase2 to be output between reference crank angle positions #1 and #2 is output, is detected as the reference crank angle position of #2 cylinder (refer to FIG. 10(A)).

Further, after judging either one of the above-mentioned two specific cylinders (#5 cylinder and #2 cylinder), the cylinders other than these specific cylinders are judged as follows.

That is, there are provided a counter BREFCAM1 that is counted up for every output of the cylinder judgment signal Phase1 and is cleared at the timing when #5 cylinder is detected, and a counter BREFCAM2 that is counted up for every output of the cylinder judgment signal Phase2 and is cleared at the timing when #2 cylinder is detected, and, based on the counted value of either counter BREFCAM1 or counter BREFCAM2, cylinder judgment is performed. Specifically, #6 cylinder is judged when the counted value of counter BREFCAM1 becomes 1 after detecting #5 cylinder, and #1 cylinder is judged when the counted value reaches 3. Further, #3 cylinder is judged when the counted value of counter BREFCAM2 becomes 1 after detecting #2 cylinder, and #4 cylinder is judged when the value reaches 3 (refer to FIG. 10(B)).

As above, the number of outputs of the cylinder judgment signals to be output from a predetermined cam sensor after the cylinder judgment signal for establishing judgment of a specific cylinder are made to correspond to each cylinder other than the specific cylinder, so that each cylinder other than the specific cylinder can be judged based on the number of outputs.

Next, the above-mentioned backup control will be described in detail with reference to a flowchart.

Figure 11:
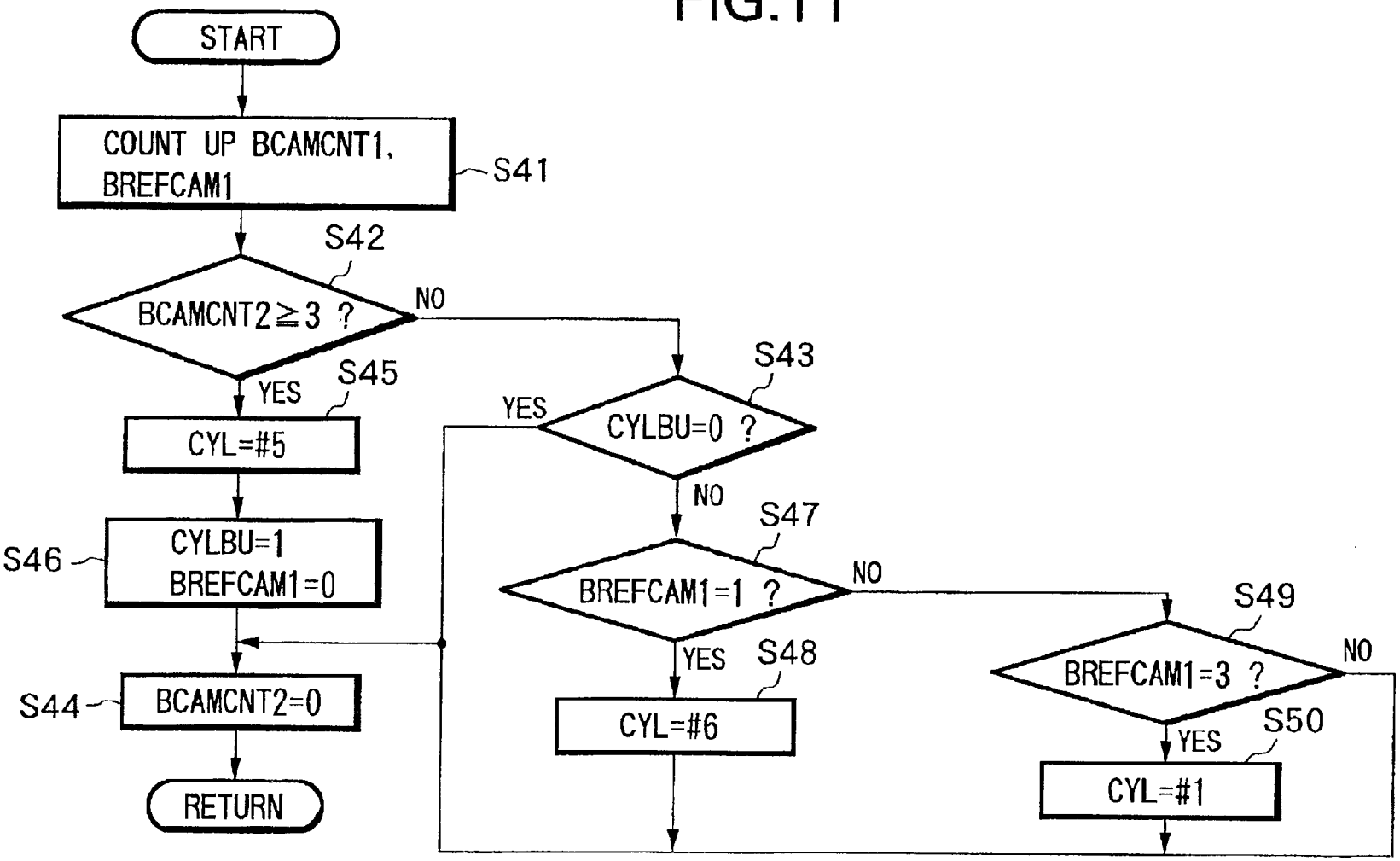
FIG. 11 is a flowchart showing a counting process by interruption of a cylinder judgment signal Phase1 in the backup control.

A flowchart of FIG. 11 is a routine to be interruptedly executed whenever the cylinder judgment signal Phase1 is output after starting the backup control, wherein in step S41, counter BCAMCNT1 and counter BREFCAM2 are each counted up.

In step S42, it is judged whether or not the counted value of counter BCAMCNT2 is three or greater.

If the counted value is less than three, control proceeds to step S43, wherein it is judged whether or not an initial judgment flag CYLBU is 0 (an initial value when starting the backup control is 0).

If the initial judgment flag CYLBU is 0, since a first judgment of either one of the specific cylinders is not completed yet, and accordingly, the judgment of other cylinders cannot be performed, control proceeds to step S44, wherein counter BCAMCNT2 is reset and then the present flow is terminated.

If it is judged in step S42 that the counted value of counter BCAMCNT2 is three or greater, control proceeds to step S45, wherein it is judged that the specific cylinder is #5 cylinder. The time of this judgment is the reference crank angle position of #5 cylinder, and based thereon, an ignition timing control, a fuel injection control and the like are performed (the same for all following steps).

Then, in step S46, after the initial judgment flag CYLBU is set to 1 and counter BREFCAM1 is reset, in step S44, counter BCAMCNT2 is reset and the present flow is terminated.

After the judgment of #5 cylinder is performed as above (or the judgment of #2 cylinder is performed in advance as explained in the following) and the initial judgment flag CYLBU is set to 1, control proceeds to step S47, wherein it is judged whether or not the counted value of counter BREFCAM1 is 1. If the counted value is 1, in step S48, it is judged that the specific cylinder is #6 cylinder. Further, if the counted value of counter BREFCAM1 is not 1, it is judged in step S49 whether or not the counted value is 3, and if it is 3, in step S50, it is judged that the specific cylinder is #1 cylinder. After these cylinder judgments, control proceeds to step S44 before the present flow is terminated.

Further, when the counted value of counter BREFCAM1 is judged to be other than 1 or 3, control proceeds to step S44 before the present flow is terminated.

Figure 12:
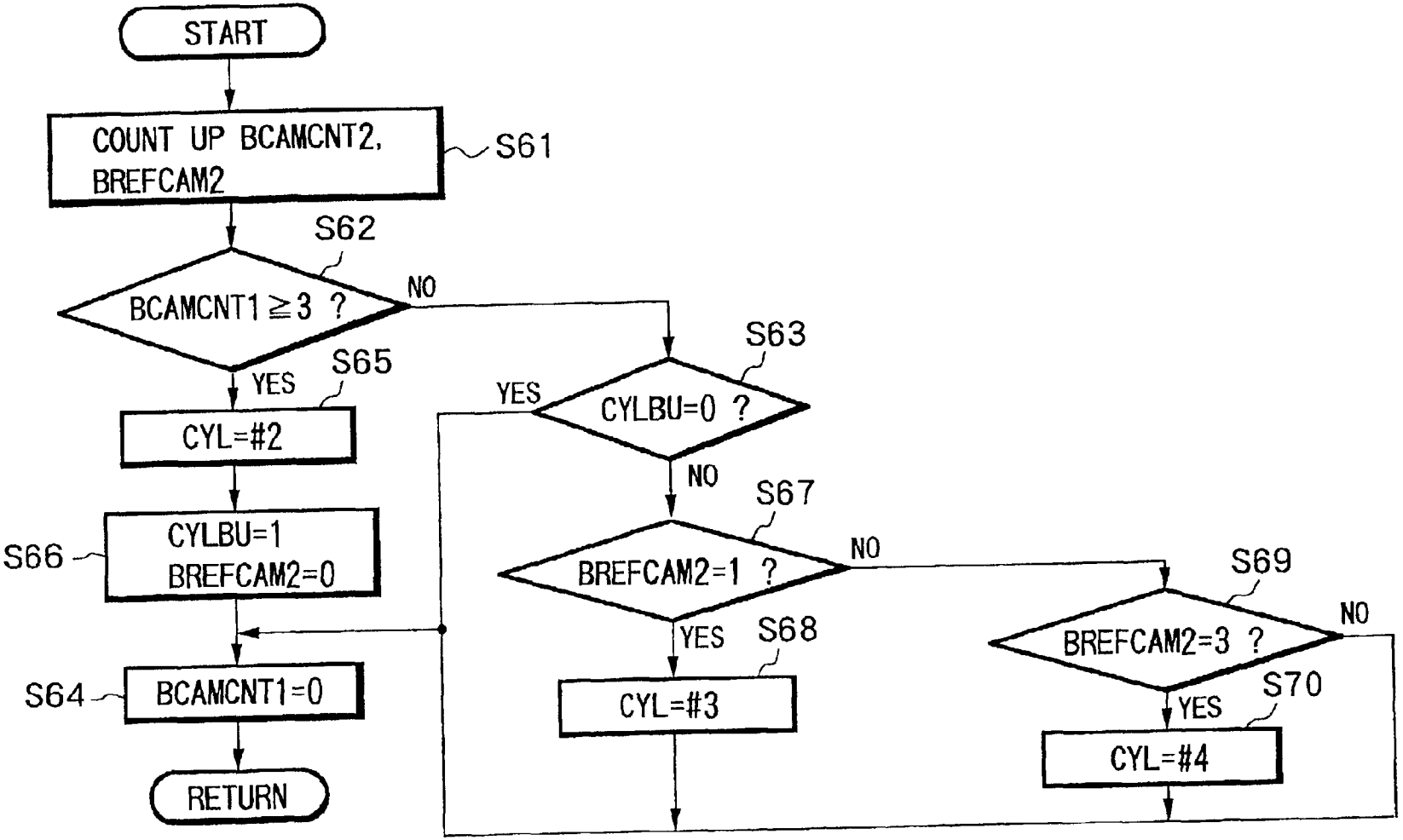
FIG. 12 is a flowchart showing a counting process by interruption of a cylinder judgment signal Phase2 in the backup control.

On the other hand, a flowchart of FIG. 12 is a routine to be interruptedly executed whenever the cylinder judgment signal Phase2 is output after starting the backup control, wherein similar to FIG. 11, #2 cylinder is judged when the counted value of counter BCAMCNT2 is 3 or more, and thereafter, when the counted value of counter BCAMCNT2 is 1, #3 cylinder is judged, and when the counted value of counter BREFCAM2 is 3, #4 cylinder is judged, sequentially.

As above, at a normal time of the crank angle sensor, the cylinder is judged based on the reference crank angle position to be detected based on the crank angle signal output from the crank angle sensor and based on the cylinder judgment signal from the cam sensor, to control fuel injection, ignition timing and the like, and at a failed time of the crank angle sensor, the cylinder is judged based only on the cylinder judgment signals from a plurality of the cam sensors, thereby compensating for necessary engine control.

However, when noise is mixed in the backup control, there is a possibility that the noise is erroneously detected as the cylinder judgment signal to perform erroneous cylinder judgment.

Figure 15:
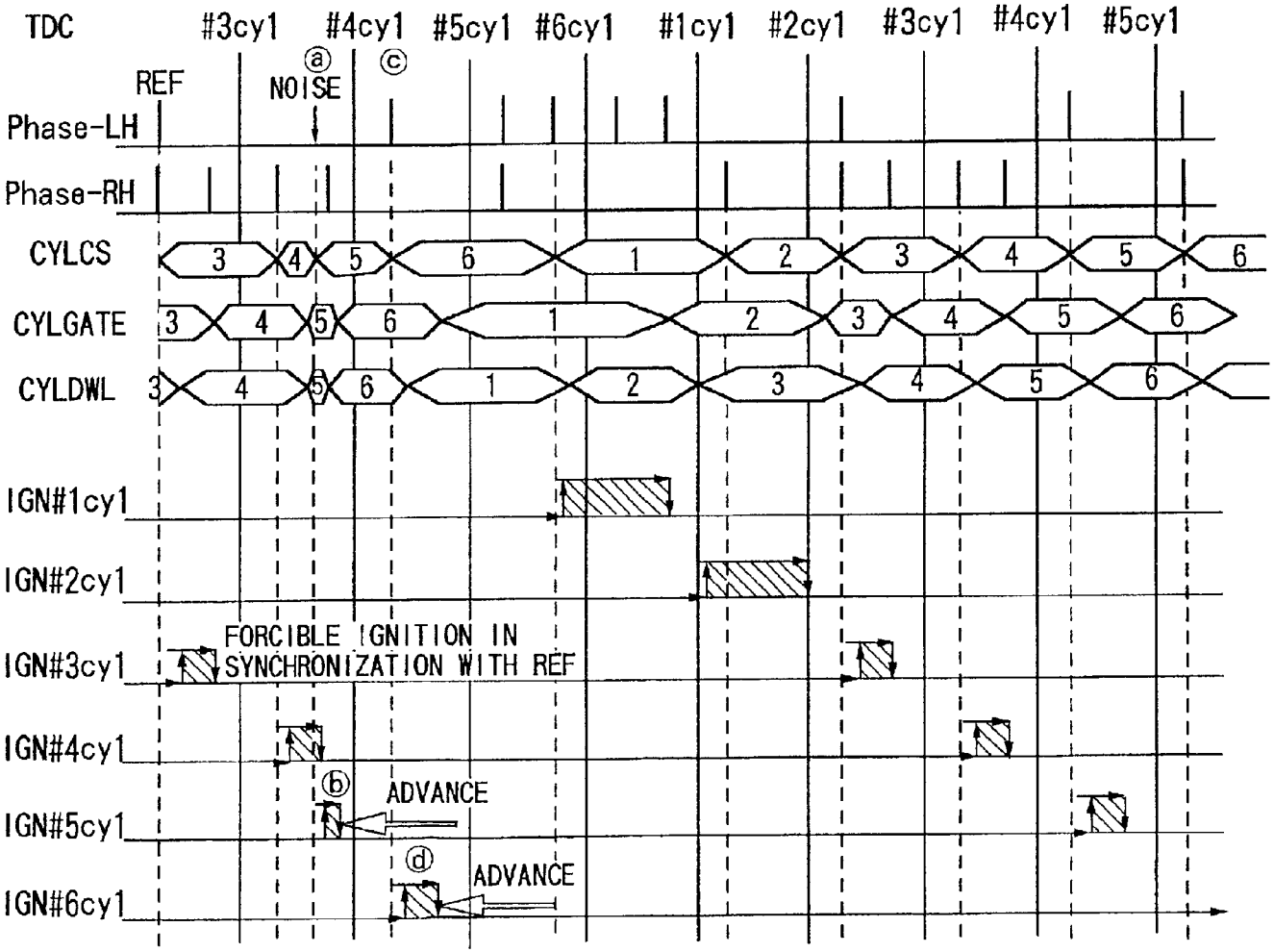
FIG. 15 is a time chart showing a state of noise mixing when the above control is not executed.

For example, as shown in FIG. 15, when the noise occurred at timing "a" is erroneously detected as the cylinder judgment signal Phase1, firstly this timing is judged as the reference crank angle position. Then, during a time from the previous correct cylinder judgment signal Phase1 is output until the noise is erroneously detected as the cylinder judgment signal Phase1, it is judged that the cylinder judgment signal Phase2 is input three times and #5 cylinder is erroneously judged. At that time, #4 cylinder is forcibly ignited, and also the power supply to an ignition circuit of #5 cylinder is started at once and then cut off after the lapse of predetermined time, to ignite #5 cylinder (timing "b" shown in the figure). Afterwards, when the correct cylinder judgment signal Phase1 is output, #6 cylinder is erroneously judged (correctly #5 cylinder), and also immediately thereafter, the power supply to an ignition circuit of #6 is started (timing "c" shown in the figure) and then cut off after the lapse of predetermined time, to ignite #6 cylinder (timing "d" shown in the figure). As above, since the reference crank angle position REF is detected with deviation of 120°, the power supply and ignition timing to #5 cylinder and #6 cylinder are overly advanced with 120°, thereby deteriorating drivability and thus possibly bringing engine stall. The power supply timing (CYLDWL) and ignition timing (CYLADV) due to the stop of power supply, to ignition circuit of each cylinder are set after a predetermined time from the cylinder judged reference crank angle position REF.

In order to avoid occurrence of such problem, according to the present invention, a failsafe control is performed to prevent the above erroneous cylinder judgment caused by the erroneous detection of the cylinder judgment signal by the noise mixing, at the same time of the above backup control.

Figure 13:
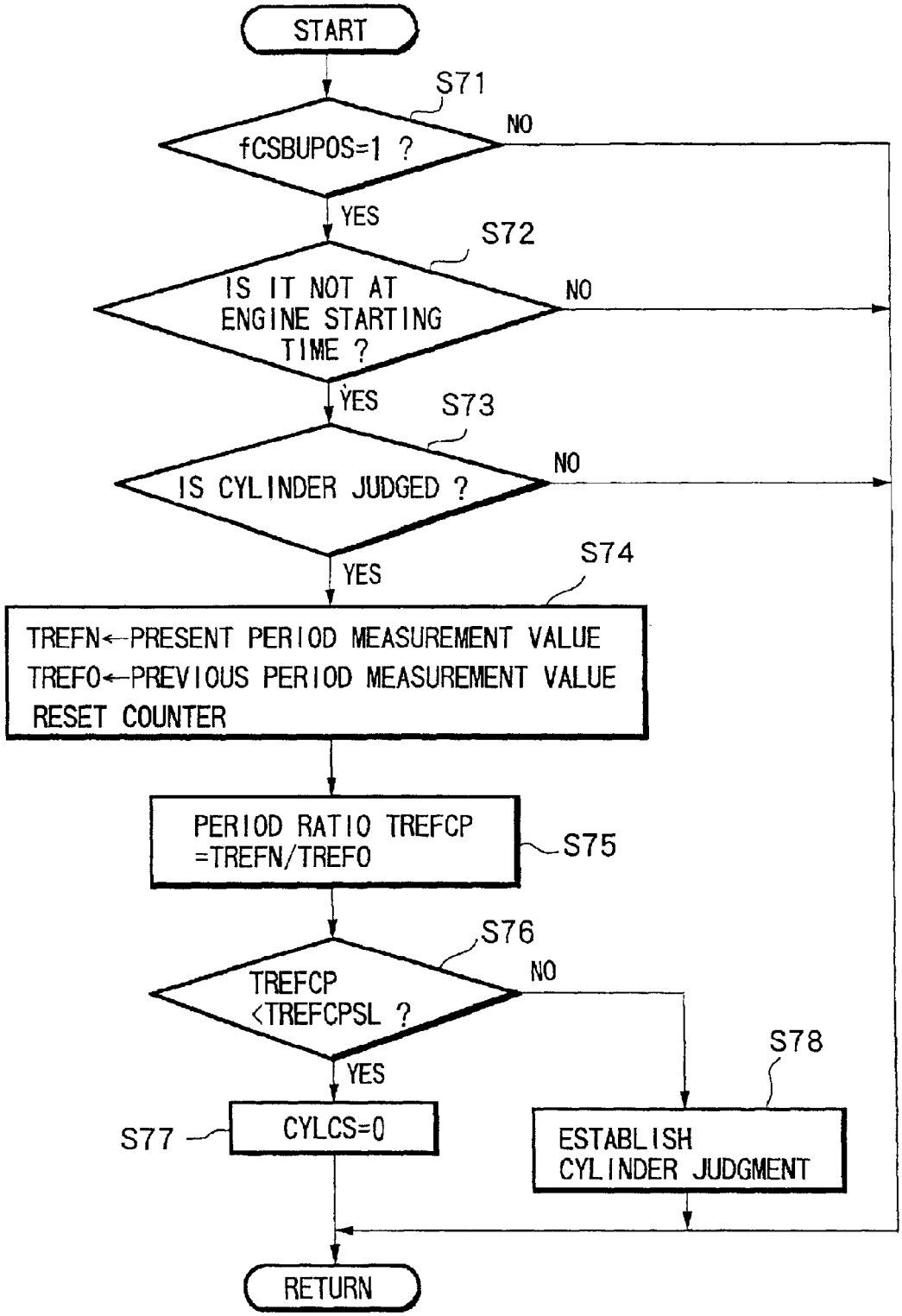
FIG. 13 is a flowchart showing a control according to the present invention to be executed at the same time of the above backup control.

FIG. 13 shows a flowchart of the failsafe control. This flow is a routine to be executed for each interruption occurrence by the cylinder judgment signal Phase1 or Phase 2. Accordingly, if the noise is mixed at the backup control, to be erroneously detected as the cylinder judgment signal Phase1 or Phase 2, this flow is also executed.

In step 71, it is judged whether or not the backup control is being performed using a value of a flag fCSBUPOS (the value=1 during the backup control).

When it is judged that the backup control is being performed, control proceeds to step S72, wherein it is judged whether or not it is at the engine starting time (cranking time). This is because, at the engine starting time, there is a high possibility to erroneously detect noise mixing due to a later described ratio TREFCP being small.

When it is judged that it is not the engine starting time, control proceeds to step S73, wherein it is judged whether or not a cylinder is judged by the present cylinder judgment signal Phase1 or Phase2 (whether or not the reference crank angle position of a predetermined cylinder is detected).

When it is judged that the cylinder is judged, control proceeds to step S74, wherein a period, counted by a counter, of from the previous cylinder judgment to the present cylinder judgment is read in, to be set as the present calculation value TREFN. The period counted at the previous time as in the same manner as above is replaced by the previous calculation value TREFO and the counter is reset to newly start counting.

In step S75, a ratio (TREFCP=TREFN/TREFO) between the present calculation value TREFN and the previous calculation value TREFO of the period is calculated.

Figure 14:
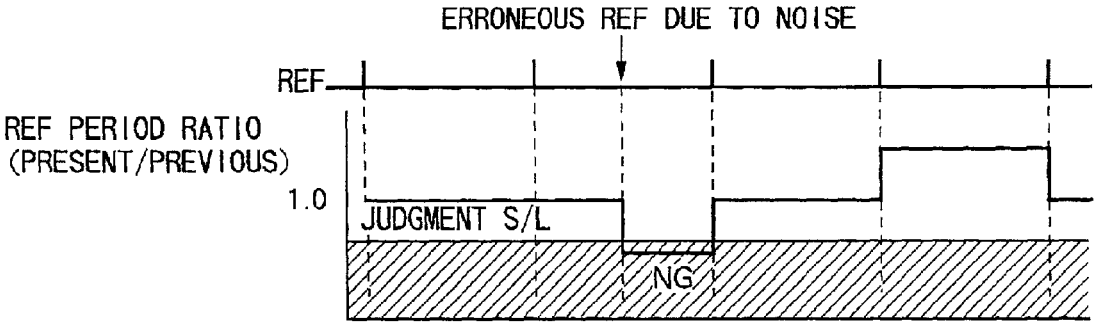
FIG. 14 is a view explaining a threshold value of a period ratio of the above control.

In step S76, it is judged whether or not the ratio TREFCP is smaller than a threshold value TREFCPSL. Here, the threshold value TREFCPSL is made smaller than a value of when the ratio TREFCP becomes the smallest at the normal operating condition (except for the starting time). Specifically, the threshold value is made smaller than a value (approximately 0.8) at the time of idling at the neutral position, thereby preventing the erroneous judgment of the noise mixing. Even when the ignition timing is advanced at the backup control due to the noise mixing, in a case where the advance amount, in fact, has no problem, the ignition is preferably performed. Specifically, there is no problem that the ignition is performed to the extent of an advance amount in which the period ratio corresponds to TREFN/TREFO= 80/120=0.67 approximately, but the problem occurs when the advance amount becomes smaller than the above amount. Accordingly, the period ratio is set to, for example, approximately 0.7 with an allowance (see FIG. 14).

In step S76, when it is judged that the ratio TRECP is smaller than the threshold value TREFCPSL, control proceeds to step S77, wherein CYLCS=0 to cancel the cylinder judgment result by the backup control and then the ignition and the like based on the cylinder judgment result are not performed.

In step S76, when it is judged that the ratio TREFCP is equal to or more than the threshold value TREFCPSL, control proceeds to step S78, wherein the cylinder judgment result by the backup control is established.

Even if the cylinder judgment is cancelled by detecting the noise mixing to stop the ignition control corresponding to the cylinder judgment result, if there is no noise mixing afterwards, the normal backup control is restored immediately to resume the ignition control and the like based on the normal cylinder judgment result.

As above, the period for each cylinder judgment is counted, and, based on the ratio between the previous calculation value and the present calculation value, the erroneous detection of the cylinder judgment signal due to noise can be judged. When the erroneous detection is judged, the cylinder judgment result based on the cylinder judgment signal is cancelled, thereby avoiding the ignition timing control defection based on the erroneous cylinder judgment to ensure the stable control.

Further, rotation variations are large at the engine starting time, and there is a large possibility to erroneously judge the noise mixing in the judgment based on the ratio for the noise mixing detection even in the normal operating condition. Therefore, it is prohibited to judge the erroneous detection of the cylinder judgment signal due to noise, to enhance reliability of judgment.

According to the present embodiment, two cam sensors are disposed separately on each camshaft on the two banks for the V-type engine and, thereby avoiding an increase of the size in a length direction of the camshaft in comparison with two cam sensors being disposed on one camshaft.

Figure 16:
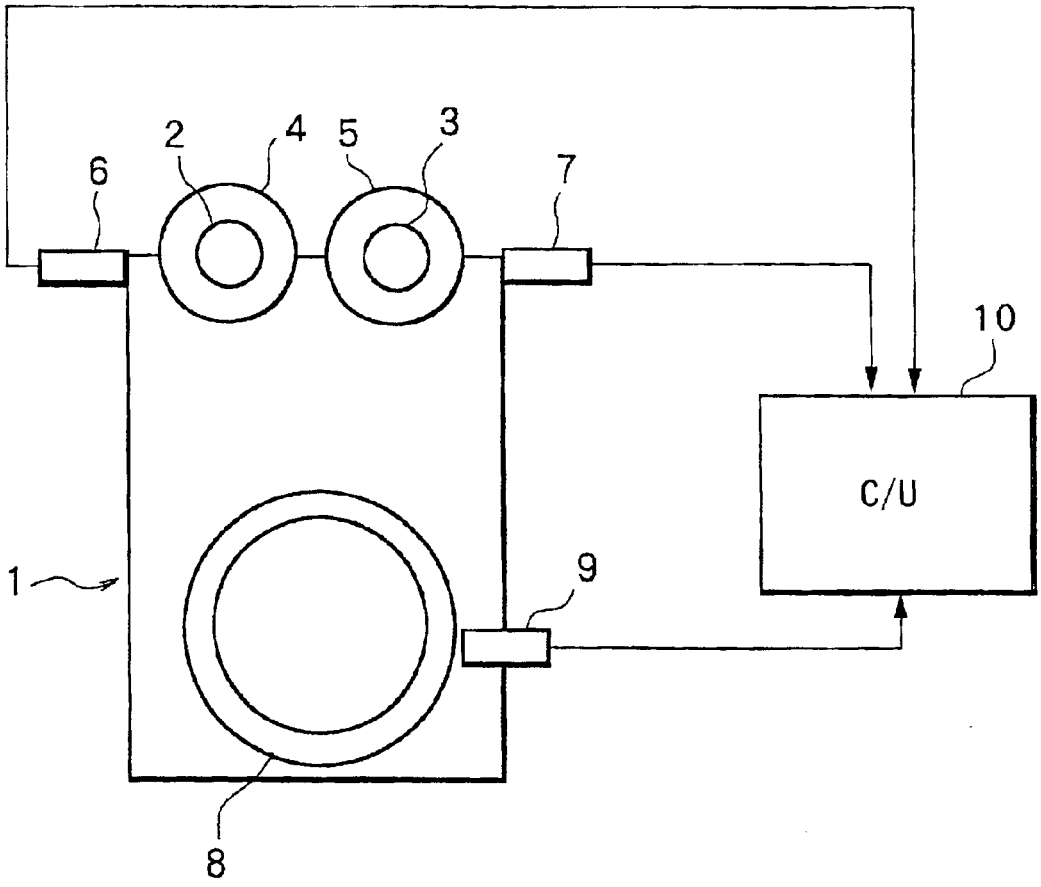
FIG. 16 is a diagram showing a system structure of an in-line six-cylinder engine in a second embodiment of the present invention.

FIG. 16 shows a second embodiment in which a first cam sensor 6 and a second cam sensor 7 similar to the above are disposed on intake side cam shaft 2 and exhaust side cam shaft 3 for in-line six-cylinder engine 1. A cylinder judgment control is performed in the same manner as in the first embodiment.

Accordingly, similarly to the first embodiment, two cam sensors are disposed separately on different camshafts so that an increase of the size in a length direction of the camshaft can be avoided and at the same time, when the crank angle sensor is abnormal, the cylinder judgment can be performed based only on signals from the two cam sensors to perform a failsafe control.

The entire contents of Japanese Patent Application No. 2001-186639, filed Jun. 20, 2001 are incorporated herein by reference.

While only selected embodiments have been chosen to illustrate the present invention, it will be apparent to those skilled in the art from this disclosure that various change and modification can be made herein without departing from the scope of the invention as defined in the appended claims.

Furthermore, the forgoing description of the embodiment according to the present invention are provided for illustration only, and not for the purpose of limiting the invention as defined by the appended claims and their equivalents.

What is claimed is:

1. A cylinder judgment apparatus of an engine comprising:

a plurality of cam sensors each of which outputs cylinder judgment signals at every uneven crank angle interval; and a control unit that is input with cylinder judgment signals from said plurality of cam sensors, and judges a cylinder corresponding to each stroke in combustion cycle based on said cylinder judgment signals, wherein said control unit:

counts up the number of cylinder judgment signals output from one cam sensor during a time period between a previous output and a present output of cylinder judgment signals from the other cam sensor, to judge a specific cylinder based on the number of outputs, so that cylinders other than the specific cylinder are judged based on the judgment result and the cylinder judgment signals; and at the same time, each time the cylinder is judged by the above method, calculates a period of from the previous cylinder judgment to the present cylinder judgment, to judge erroneous detection of cylinder judgment signal due to noise based on a ratio between a previous calculation value and a present calculation value of said period, and when said erroneous detection is judged, cancels the cylinder judgment result based on said cylinder judgment signals.

2. A cylinder judgment apparatus of an engine according to claim 1, further comprising:

a crank angle sensor that outputs a crank angle signal capable of detecting a reference crank angle position of each stroke phase difference between the cylinders, in synchronization with rotation of a crankshaft, wherein said control unit diagnoses an abnormality of said crank angle sensor, and performs cylinder judgment based on said detected reference crank angle position and the cylinder judgment signals from said cam sensors at a normal time of the crank angle sensor and performs cylinder judgment based only on the cylinder judgment signals from the cam sensors at an abnormal time of the crank angle sensor.

3. A cylinder judgment apparatus of an engine according to claim 1, wherein said control unit judges the cylinders other than the specific cylinder based on the number of outputs of the cylinder judgment signals from the cam sensors corresponding to the cylinders to be judged immediately after the specific cylinder is judged.

4. A cylinder judgment apparatus of an engine according to claim 1, wherein said control unit judges erroneous detection of the cylinder judgment signal due to noise when a ratio between a previous calculation value and a present calculation value of said period is smaller than a threshold value.

5. A cylinder judgment apparatus of an engine according to claim 4, wherein said control unit prohibits the judgment of the erroneous detection of the cylinder judgment signal due to said noise at an engine starting time.

6. A cylinder judgment apparatus of an engine according to claim 1, wherein said engine is a V-type engine, and said plurality of cam sensors are disposed so as to correspond to each V-shape cylinder bank.

7. A cylinder judgment apparatus of an engine according to claim 1, wherein said engine is equipped with an intake side camshaft and an exhaust side camshaft, and said cam sensors are respectively disposed on each of said intake side camshaft and exhaust side camshaft.

8. A cylinder judgment apparatus of an engine comprising:

a plurality of cam sensors each of which outputs cylinder judgment signals at every uneven crank angle interval;

signal output number counting means for counting up the number of cylinder judgment signals output from one cam sensor during a time period between a previous output and a present output of cylinder judgment signals from the other cam sensor;

cylinder judgment means for judging a specific cylinder based on the number of outputs counted up by said signal output number counting means, and judging cylinders other than the specific cylinder based on the judgment result and the cylinder judgment signals;

erroneous detection judgment means for calculating, each time the cylinder is judged by said cylinder judgment means, a period of from the previous cylinder judgment to the present cylinder judgment, to judge erroneous detection of cylinder judgment signal due to noise based on a ratio between a previous calculation value and a present calculation value of said period; and judgment result cancel means for, when said erroneous detection is judged by said erroneous detection judgment means, canceling the cylinder judgment result by said cylinder judgment means.

9. A cylinder judgment method of an engine for judging a cylinder corresponding to each stroke in engine combustion cycle, comprising the steps of:

outputting cylinder judgment signals from a plurality of cam sensors at every uneven crank angle interval;

counting up the number of cylinder judgment signals output from one cam sensor during a time period between a previous output and a present output of cylinder judgment signals from the other cam sensor;

judging a specific cylinder based on the number of outputs counted up, and judging cylinders other than the specific cylinder based on the judgment result and the cylinder judgment signals;

calculating, each time the cylinder is judged, a period of from the previous cylinder judgment to the present cylinder judgment, to judge erroneous detection of cylinder judgment signal due to noise based on a ratio between a previous calculation value and a present calculation value of said period; and when said erroneous detection is judged, canceling the cylinder judgment result based on said cylinder judgment signals.

10. A cylinder judgment method of an engine according to claim 9, wherein said step of judging the cylinder judges the cylinders other than the specific cylinder based on the number of outputs of the cylinder judgment signals from the cam sensors corresponding to the cylinders to be judged immediately after the specific cylinder is judged.

11. A cylinder judgment method of an engine according to claim 9, wherein said step of judging erroneous detection of the cylinder judging signals judges erroneous detection of the cylinder judgment signal due to noise when a ratio between a previous calculation value and a present calculation value of said period is smaller than a threshold value.

12. A cylinder judgment method of an engine according to claim 10, further comprising the step of:

prohibiting the judgment of the erroneous detection of the cylinder judgment signal due to said noise at an engine starting time.

* * * * *